US005791206A

United States Patent [19]

Daigle et al.

[11] Patent Number: 5,791,206

[45] Date of Patent: Aug. 11, 1998

[54] DRILL PIPE HANDLING MECHANISM

[75] Inventors: Odee P. Daigle, Garland; James E. Morris, Dallas, both of Tex.

[73] Assignee: Ingersoll-Rand Company, Woodcliff Lake, N.J.

[21] Appl. No.: 762,906

[22] Filed: Dec. 10, 1996

[51] Int. Cl.[6] ..... B25B 13/50

[52] U.S. Cl. ..... 81/57.33; 81/57.19; 81/57.2; 81/57.35

[58] Field of Search ..... 81/57.33, 57.34, 81/57.35, 57.4, 57.42, 57.44, 90.1, 90.3, 90.9, 129, 129.5, 132, 142, 54, 57.19, 57.2

[56] References Cited

U.S. PATENT DOCUMENTS

| | | | |
|---|---|---|---|
| 2,746,329 | 4/1956 | Paget | 81/57.19 |
| 3,500,708 | 3/1970 | Wilson . | |
| 3,680,412 | 8/1972 | Mayer et al. . | |
| 3,832,918 | 9/1974 | Lang et al. | 81/57.33 |
| 4,128,135 | 12/1978 | Mitchhart et al. . | |
| 4,194,419 | 3/1980 | Mitchhart et al. . | |
| 4,576,067 | 3/1986 | Buck | 81/185.1 |
| 5,537,900 | 7/1996 | Schaar . | |

*Primary Examiner*—D. S. Meislin
*Assistant Examiner*—Benjamin M. Halpern
*Attorney, Agent, or Firm*—John J. Selko

[57] ABSTRACT

A breakout wrench for making and breaking joints between successive drill pipe in a drill string on a drilling rig includes a swing arm pivotable between a storage and a pipe gripping position. The swing arm carries a first and second pipe gripping jaw, the first jaw movable relative to the swing arm, and the second jaw movable relative to the first jaw. Both jaws are freely movable, to a slight degree, in all directions in the plane of their movement, to permit self-adjustment of position to the wrench relative to a drill pipe centerline. A double-rod hydraulic cylinder actuates both jaws.

4 Claims, 2 Drawing Sheets

DRILL PIPE HANDLING MECHANISM

BACKGROUND OF THE INVENTION

This invention relates generally to drilling rigs and more particularly to breakout wrenches used to make and break joints between successive lengths of drill pipe in a drill string. Prior art breakout wrenches are complicated devices and require many interacting subassemblies. One example of prior art breakout wrenches is described in U.S. Pat. No. 4,194,419 to Ray M. Mitchhart et al. Moreover, as the diameter of drill pipe varies, either due to wear, or operator selection, prior art breakout wrenches do not readily adjust their pipe gripping location.

The foregoing illustrates limitations known to exist in present breakout wrenches. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a drill string makeup and breakout wrench for use on a drill rig comprising: an swing arm mounted on the drill rig for pivotal movement between a storage position and a position for engaging a drill pipe section, the swing arm carrying a gripping member for engaging the drill pipe section; a first jaw slidably mounted on the swing arm; a second jaw mounted on the first jaw, the second jaw comprising an engagement arm having an elongated body ending in a first and second end, the engagement arm being pivotally mounted on the first jaw at position between the first and second end; the second end carrying a gripping member for engaging the drill pipe section, the engagement arm, movable, in a generally horizontal plane, between a clamping and nonclamping position with respect to the drill pipe section; a double rod hydraulic cylinder actuator pivotally connected to the swing arm and the first end of the engagement arm, whereby, during a hydraulic cylinder stroke sequence, the first and second jaw move into a drill pipe engaging position, and thereafter the second jaw moves relative to the first jaw into a drill string clamping and rotating position; and guide means connecting the swing arm and first jaw for guiding the slidable movement of the first jaw relative to the swing arm, in response to actuation of the hydraulic cylinder.

The foregoing and other aspects will become apparent from the following detailed description of the invention when considered in conjunction with the accompanying drawing figures.

BRIEF DESCRIPTION OF THE DRAWING FIGURES

FIG. 1 is a schematic, top plan view, partly in cross section, with parts removed, of a breakout wrench of the invention; and FIG. 2 is a schematic, side elevational view, partly in cross section, with parts removed, along 2—2 of FIG. 1, showing the stacking arrangement of movable swing arm and jaws of the invention.

DETAILED DESCRIPTION

Figure 1:
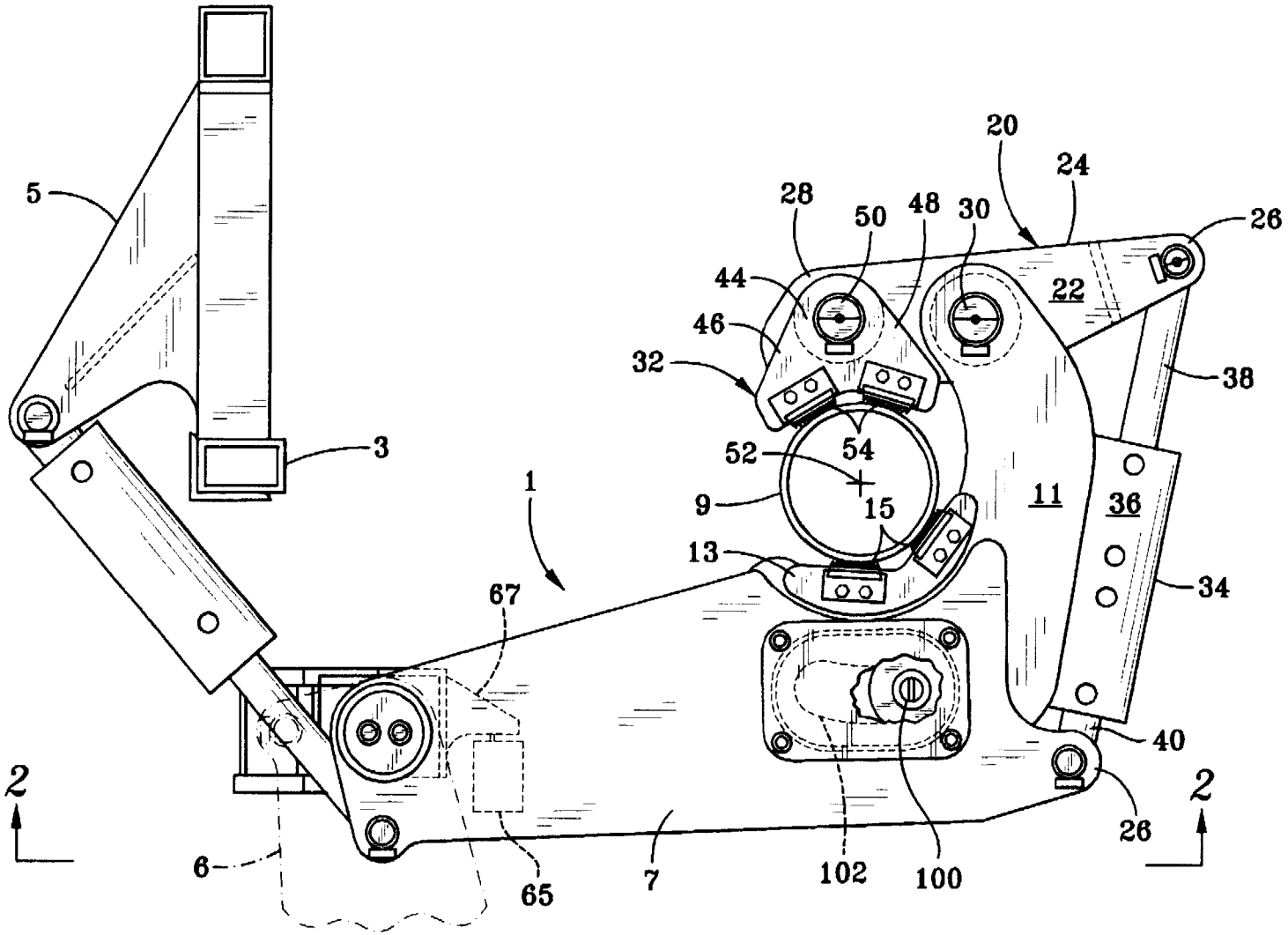

Referring to FIG. 1, the breakout wrench of the invention, shown generally as 1, is mounted on a drill rig 3 at bracket 5. Swing arm 7 is mounted for pivotal movement between a storage position 6 (shown in phantom) and a position for engaging a drill pipe 9, as shown in solid lines. First jaw 11 is slidably mounted on swing arm 7, as describe more fully hereinafter. First jaw 11 carries a gripping member 13, comprising a pair of removable, arcuately spaced apart, sawtoothed gripping inserts 15 for engaging a drill pipe section. A second jaw 20 is mounted on first jaw 11. Second jaw 20 comprises an engagement arm 22 having an elongated body 24 ending in a first end 26 and a second end 28. Engagement arm 22 is pivotally mounted on first jaw 11 at a pivot pin 30 positioned between first end 26 and second end 28. Engagement arm 22 and second end 28 are movable in a generally horizontal plane between a clamping and nonclamping position with respect to drill pipe 9. Second end 28 carries a gripping member 32 for engaging drill pipe 9, as more fully described hereinafter.

A double rod hydraulic cylinder actuator 34 is pivotally connected to swing arm 7 and first end 26 of engagement arm 22. Cylinder 34 can be similar to the type described in U.S. Pat. No. 5,343,962 to Daigle et al. Cylinder 34 includes a barrel 36 having a first piston rod 38 slidably mounted therein, and a second piston rod 40 also slidably mounted therein. Each piston rod 38, 40 is in fluid communication with a common, volumetrically variable chamber in barrel 36 (not shown). Cylinder 34 operates in a stroke sequence whereby rod 38 first extends fully, causing barrel 36 to follow. This stroke also moves second jaw 20 to a position wherein jaw 20 is able to engage drill pipe 9. When barrel 36 reaches the end of its stroke, rod 40 extends until it strokes out, causing second jaw 20 to move to its pipe clamping position, rotating drill pipe 9. Thus, the stroke of cylinder 34 is essentially first one rod and thereafter the second rod. Upon reversal of stroke, the sequence is reversed.

Gripping member 32 is pivotably mounted on second end 28 in a curved, pivotable die holder having a body 44 forming a first and second leg 46, 48, respectively. Legs 46, 48 extend in angular juxtaposition to each other. Die holder body of gripping member 32 is pivotably mounted on second arm end 28 at a pivot pin 50 extending vertically with respect to the horizontal plane of movement of engagement arm 22. First and second legs 46, 48 pivot freely in an arc with respect to a vertical centerline axis 52 extending through drill pipe 9 prior to gripping member 32 clamping pipe 9. Removably mounted in each leg 46, 48 is a sawtoothed gripping insert 54.

Figure 2:
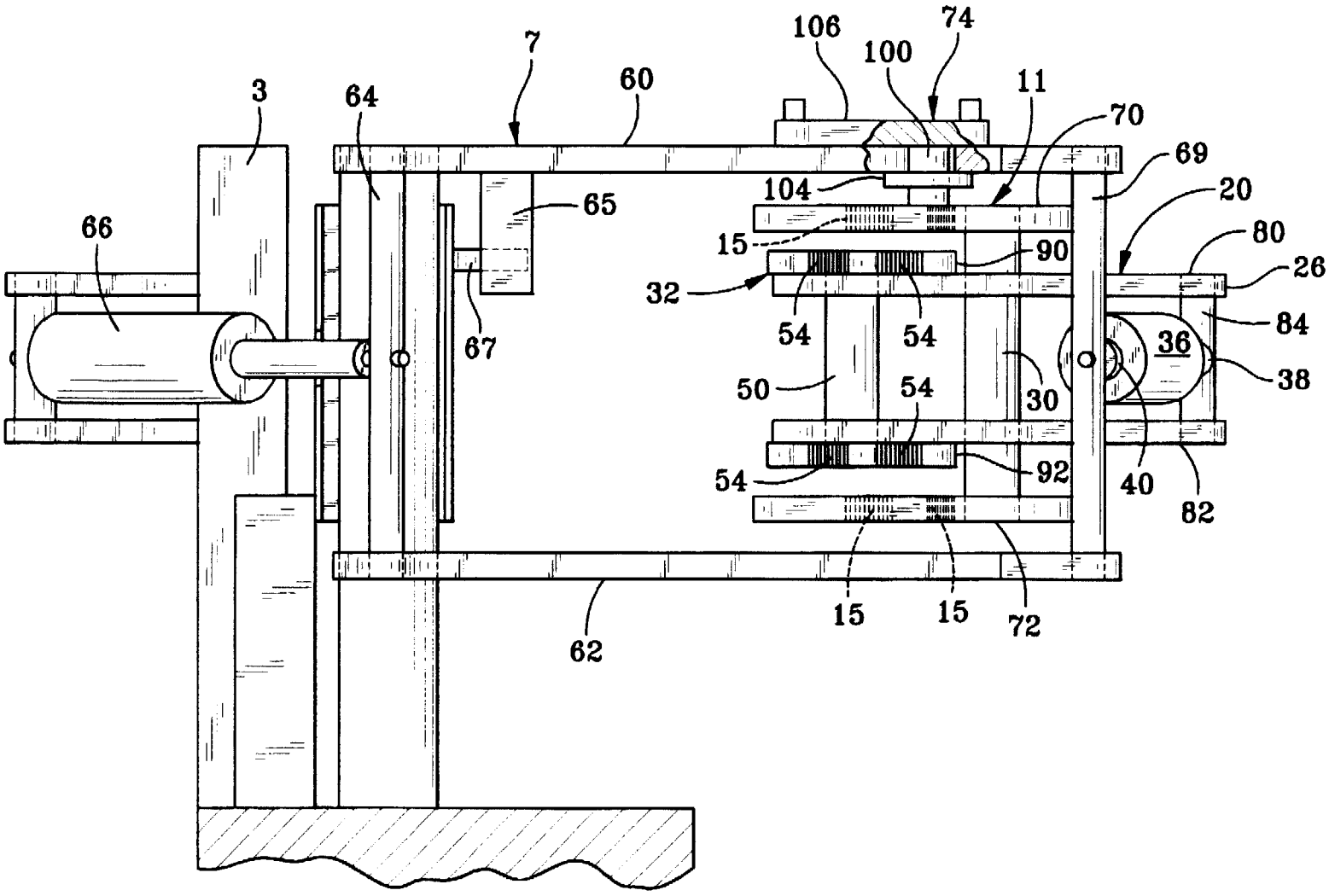

FIG. 2 shows a preferred stacking arrangement of swing arm 7, first jaw 11, second jaw 20 and gripping member 32 to, permit relative movement between elements. Swing arm 7 includes a pair of spaced-apart top and bottom plates, 60, 62, respectively. Plates 60, 62 are pivotably connected at pivot pin 64 to a hydraulic actuator cylinder 66. Cylinder 66 is connected at its barrel end to drill rig 3 (FIG. 1) and at its rod end to pivot pin 64. Plates 60, 62 are pivotably connected at pivot pin 66 to second piston rod 40, as described hereinabove. In response to actuator 66, swing arm 7 and wrench 3 pivot between a storage position and pipe clamping position. A stop block 65 on swing arm 7 and stop finger 67 on drill rig 3 (FIG. 1) contact each other to stop pivot movement of wrench 3 when it reaches the clamping position.

First jaw 11 includes a pair of spaced-apart top and bottom plates 70, 72, respectively. Plates 70, 72 are pivotably connected at pivot pin 30 that extends vertically through second jaw 20, as described hereinabove. Each plate 70, 72 carries sawtoothed gripping inserts 15. First jaw 20 is also connected to swing arm 7 by a guide means 74, as described hereinbelow.

Engagement arm 22 of second jaw 20 includes a pair of spaced-apart top and bottom plates 80, 82. Plates 80, 82 are connected at pivot pin 84 to first piston rod 38, and at pivot pin 30 to first jaw 11, as described hereinabove.

Gripping member 32 includes a pair of spaced-apart top and bottom plates 90, 92, respectively. Plates 90, 92 are connected at pivot pin 50 to plates 80, 82 of second jaw 20. Each plate 90, 92 carries sawtoothed gripping inserts 54.

Guide means 74 between swing arm 7 and first jaw 11 includes a pin 100 slidably positioned in a slot 102 in top plate 60 of swing arm 7. Pin 100 is retained in slot 102 by a washer-type retaining plate 104 on the bottom side of top plate 60 and a removable cover plate 106 on the top side of plate 60. Slot 102 is sized large enough to permit pin 100 to move, or "float", in all directions within the horizontal plane of movement of swing arm 7, but not move perpendicular to this horizontal plane.

Thus, it can be understood that the "floating" movement of pin 100 permits swing arm 7 and first jaw 11 to adjust slightly with respect to each other in all directions in response to a drill pipe 9 whose position varies slightly due to diameter variation. This "floating" movement, in combination with the freely pivoting movement of gripping member 32 provides wrench 1 with a self-adjusting capability that adapts readily to drill pipe diameter changes due to drill pipe wear or operator selection.

Having described the invention, what is claimed is:

1. A drill string makeup and breakout wrench for use on a drill rig comprising:

(a) an swing arm mounted on said drill rig for pivotal movement between a storage position and a position for engaging a drill pipe section, said swing arm carrying a gripping member for engaging said drill pipe section;

(b) a first jaw slidably mounted on said swing arm;

(c) a second jaw mounted on said first jaw, said second jaw comprising an engagement arm having an elongated body ending in a first and second end, said engagement arm being pivotally mounted on said first jaw at position between said first and second end; said second end carrying a gripping member for engaging said drill pipe section, said engagement arm, movable, in a generally horizontal plane, between a clamping and nonclamping position with respect to said drill pipe section;

(d) a double rod hydraulic cylinder actuator pivotally connected to said swing arm and said first end of said engagement arm, whereby, during a hydraulic cylinder stroke sequence, said first and second jaw move into a drill pipe engaging position, and thereafter said second jaw moves relative to said first jaw into a drill string clamping and rotating position; and (e) guide means connecting said swing arm and first jaw for guiding said slidable movement of said first jaw relative to said swing arm, in response to actuation of said hydraulic cylinder.

2. The wrench of claim 1 wherein said double rod hydraulic cylinder comprises:

(a) a cylinder barrel having a first and second piston rod slidably mounted therein;

(b) said first piston rod having one end extending out of a first end of said cylinder barrel, said extending first piston rod end being pivotally connected to said swing arm; and (c) said second piston rod having one end extending out of a second end of said cylinder barrel, said extending second piston rod end being pivotally connected to said first end of said engagement arm of said second jaw.

3. The wrench of claim 2 wherein said gripping member on said second jaw comprises:

(a) a curved, pivotable die holder having a body portion, said body portion forming a first and second leg portions, said leg portions extending in angular juxtaposition to each other, said die holder pivotally mounted on said engagement arm at said second end, at a pivot axis positioned in said body portion between said first and second leg portions, said pivot axis extending vertically with respect said horizontal plane, whereby said said first and second leg portions pivot freely in an arc with respect to a vertical centerline axis extending though said drill pipe, prior to said gripping member being positioned in said drill pipe clamping position; and (b) each leg portion carrying a removable, sawtoothed gripping insert.

4. The wrench of claim 3 wherein said guide means connecting said swing arm and first jaw further comprises restraining member means interconnecting said swing arm and first jaw for permitting said slidable movement between said swing arm and first jaw, in said horizontal plane, said movement being permitted in all directions within said horizontal plane, whereby said first jaw and second jaw can assume any of a plurality of engagement positions relative to said drill string, in response to any of a plurality of drill string diameters.

* * * * *